US008845288B2

(12) United States Patent
Tholath

(10) Patent No.: US 8,845,288 B2
(45) Date of Patent: Sep. 30, 2014

(54) TURBINE ROTOR ASSEMBLY

(75) Inventor: Abraham I. Tholath, Derby (GB)

(73) Assignee: Rolls-Royce PLC, London (GB)

( * ) Notice: Subject to any disclaimer, the term of this patent is extended or adjusted under 35 U.S.C. 154(b) by 709 days.

(21) Appl. No.: 13/151,770

(22) Filed: Jun. 2, 2011

(65) Prior Publication Data

US 2012/0003103 A1 Jan. 5, 2012

(30) Foreign Application Priority Data

Jun. 30, 2010 (GB) ..... 1010929.6

(51) Int. Cl.
*F01D 5/18* (2006.01)
*F01D 5/08* (2006.01)
*F01D 5/30* (2006.01)

(52) U.S. Cl.
CPC ..... *F01D 5/082* (2013.01); *F05D 2260/22141* (2013.01); *F01D 5/081* (2013.01); *F01D 5/3092* (2013.01)
USPC ..... 416/95; 416/219 R

(58) Field of Classification Search
CPC ..... F01D 5/02; F01D 5/081; F01D 5/082; F01D 5/3092; F05D 2260/22141
USPC ..... 415/115; 416/95, 90 R, 221, 219 R, 416/220 R
See application file for complete search history.

(56) References Cited

U.S. PATENT DOCUMENTS 2,874,932 A 2/1959 Sörensen
3,784,320 A 1/1974 Rossmann et al.

(Continued)

FOREIGN PATENT DOCUMENTS

GB 1 377 788 12/1974
GB 1 556 274 11/1979

(Continued)

OTHER PUBLICATIONS

May 14, 2012 Search Report issued in European Patent Application No. 11168586.

(Continued)

*Primary Examiner* — Dwayne J White
(74) *Attorney, Agent, or Firm* — Oliff PLC

(57) ABSTRACT

A turbine rotor assembly (32) comprising a turbine rotor (34) and a plurality of circumferentially spaced radially outwardly extending turbine rotor blades (36). The turbine rotor (34) has a rim (38) and a plurality of circumferentially spaced slots (40) provided in the rim (38) of the turbine rotor (34). Each turbine rotor blade (36) has a root (42) and the root (42) of each turbine rotor blade (36) is arranged in a corresponding one of the slots (40) in the rim (38) of the turbine rotor (34). Each of the slots (40) has a chocking device (50) and each chocking device (50) abuts a radially inner surface (52) of the slot (40) and each chocking device (50) abuts a radially inner surface (48) of the root (42) of the corresponding turbine rotor blade (36). Each chocking device (50) comprises a thermally insulating material (54) adjacent the radially inner surface (52) of the slot (40) and each chocking device (50) forming a space (56) between the thermally insulating material (4) and the radially inner surface (48) of the root (42) of the corresponding turbine rotor blade (36). The chocking devices (50) reduce the difference between the thermal response of the region of the turbine rotor (34) adjacent the slots (40) and the remainder of the turbine rotor (34) and therefore reduces the thermal stresses in the region of the turbine rotor (34) adjacent the slots (40) of the turbine rotor (34).

23 Claims, 3 Drawing Sheets

(56) References Cited

U.S. PATENT DOCUMENTS

| | | | | |
|---|---|---|---|---|
| 4,505,640 | A * | 3/1985 | Hsing et al. | 416/97 R |
| 4,659,285 | A | 4/1987 | Kalogeros et al. | |
| 5,339,619 | A | 8/1994 | Antonellis | |
| 5,735,671 | A | 4/1998 | Brauer et al. | |
| 2008/0176020 | A1 * | 7/2008 | Heng et al. | 428/49 |

FOREIGN PATENT DOCUMENTS

| | | | |
|---|---|---|---|
| GB | 2 049 068 | A | 12/1980 |
| GB | 2 265 671 | A | 10/1993 |
| GB | 2 412 699 | A | 10/2005 |
| JP | A-63-173801 | | 7/1988 |
| JP | A-63-306206 | | 12/1988 |
| JP | A-2-169804 | | 6/1990 |
| JP | A-2-169805 | | 6/1990 |
| JP | A-2002-201908 | | 7/2002 |

OTHER PUBLICATIONS

Sep. 28, 2010 Search Report issued in British Application No. 1010929.6.

* cited by examiner

TURBINE ROTOR ASSEMBLY

The present invention relates to a turbine rotor assembly and in particular to a turbine rotor assembly for a gas turbine engine.

A turbine rotor assembly comprises a turbine rotor carrying a plurality of circumferentially spaced radially outwardly extending turbine rotor blades. The turbine rotor has a rim and a plurality of circumferentially spaced slots provided in the rim of the turbine rotor. Each turbine rotor blade has a root and the root of each turbine rotor blade is arranged in a corresponding one of the slots in the rim of the turbine rotor. The roots of the turbine rotor blades are generally firtree shaped in cross-section and the slots in the turbine rotor are correspondingly shaped to receive the roots of the turbine rotor blades.

Commonly the turbine rotor blades are hollow and are provided with internal cooling passages to allow a flow of coolant there-through to cool the turbine rotor blades. The coolant is supplied along each slot of the turbine rotor to an aperture, or to apertures, in a radially inner surface of the corresponding turbine rotor blade.

In operation heat is transferred from the turbine rotor to the coolant flowing along and/or through the slots in the turbine rotor. As a result of the heat transfer from the turbine rotor to the coolant flow in the slots of the turbine rotor the thermal response of the region of the turbine rotor adjacent the slots with variations in thrust of the gas turbine engine is relatively fast. However, the remainder, the bulk, of the turbine rotor especially the hub, or bore, of the turbine rotor has a much slower thermal response with variations in thrust of the gas turbine engine. This difference between the thermal response of the region of the turbine rotor adjacent the slots and the remainder of the turbine rotor results in high thermal stresses in the region of the turbine rotor adjacent the slots of the turbine rotor.

Accordingly the present invention seeks to provide a turbine rotor assembly which reduces, preferably overcomes, the above mentioned problem.

Accordingly the present invention provides a turbine rotor assembly comprising a turbine rotor and a plurality of circumferentially spaced radially outwardly extending turbine rotor blades, the turbine rotor having a hub, a rim and a plurality of circumferentially spaced slots provided in the rim of the turbine rotor, each turbine rotor blade having a root, the root of each turbine rotor blade being arranged in a corresponding one of the slots in the rim of the turbine rotor, each turbine rotor blade being hollow, each turbine rotor blade being provided with at least one internal cooling passage for a coolant, each turbine rotor blade having at least one aperture arranged to supply coolant to the at least one internal cooling passage in the turbine blade, at least one of the slots having a thermally insulating material adjacent the radially inner surface of the slot wherein the thermally insulating material reduces the temperature gradient between a region of the turbine rotor adjacent the at least one slot and the hub of the rotor.

At least one of the slots may have a chocking device, the at least one chocking device abutting a radially inner surface of the slot, the chocking device abutting a radially inner surface of the root of the corresponding turbine rotor blade, the chocking device comprising a thermally insulating material adjacent the radially inner surface of the slot, and the chocking device forming a space between the thermally insulating material and the radially inner surface of the root of the corresponding turbine rotor blade.

Each of the slots may have a chocking device, each chocking device abutting a radially inner surface of the slot, each chocking device abutting a radially inner surface of the root of the corresponding turbine rotor blade, each chocking device comprising a thermally insulating material adjacent the radially inner surface of the slot and each chocking device forming a space between the thermally insulating material and the radially inner surface of the root of the corresponding turbine rotor blade.

Each chocking device may comprise a member, a thermally insulating material being arranged on a radially inner surface of the member and a plurality of projections extending radially outwardly from the member.

Each chocking device may comprise a sheet member, a thermally insulating material being arranged on a radially inner surface of the sheet member and a plurality of projections extending radially outwardly from the sheet member.

Each chocking device may comprise at least one wire member, a thermally insulating material being arranged on a radially inner surface of the wire member and a plurality of projections extending radially outwardly from the wire member.

The wire member may comprise at least one bent wire member or a plurality of wires welded together.

Alternatively at least one of the slots may have a plate member, the at least one plate member abutting a radially inner surface of the slot, the plate member having a thermally insulating material adjacent the radially inner surface of the slot, and the plate member forming a space between the thermally insulating material and the radially inner surface of the root of the corresponding turbine rotor blade.

Each of the slots may have a plate member, each plate member abutting a radially inner surface of the slot, each plate member comprising a thermally insulating material adjacent the radially inner surface of the slot and each plate member forming a space between the thermally insulating material and the radially inner surface of the root of the corresponding turbine rotor blade.

The turbine rotor assembly may comprise a rim cover plate at a first axial end of the turbine rotor and a seal plate at a second axial end of the turbine rotor, each plate member being supported by the rim cover plate and/or the seal plate.

Alternatively a retaining structure on the radially inner end of at least one of the turbine rotor blades may retain the thermally insulating material.

The thermally insulating material may comprise a material with low density and low thermal conductivity. The density may be about 0.18 $gc^{-3}$. The thermal conductivity may be about 90 $W/m^{-K}$ at 650° C. The thermally insulating material may have a thickness of 5 mm to 10 mm.

The thermally insulating material may comprise an aerogel. The thermally insulating material comprises a silica aerogel. The thermally insulating material may comprise silica aerogel containing reinforcing fibres. The thermally insulating material may comprise silica aerogel containing non-woven reinforcing fibres. The thermally insulating material may comprise silica aerogel containing reinforcing glass fibres.

Each turbine rotor blade may have at least one aperture in a radially inner surface of the root.

Each turbine rotor blade may have at least one aperture in a surface of a shank.

The thermally insulating material may comprise air.

The turbine rotor may be a turbine disc.

The turbine rotor assembly may be a gas turbine engine turbine rotor assembly.

The present invention will be more fully described by way of example with reference to the accompanying drawings, in which:—

Figure 1:
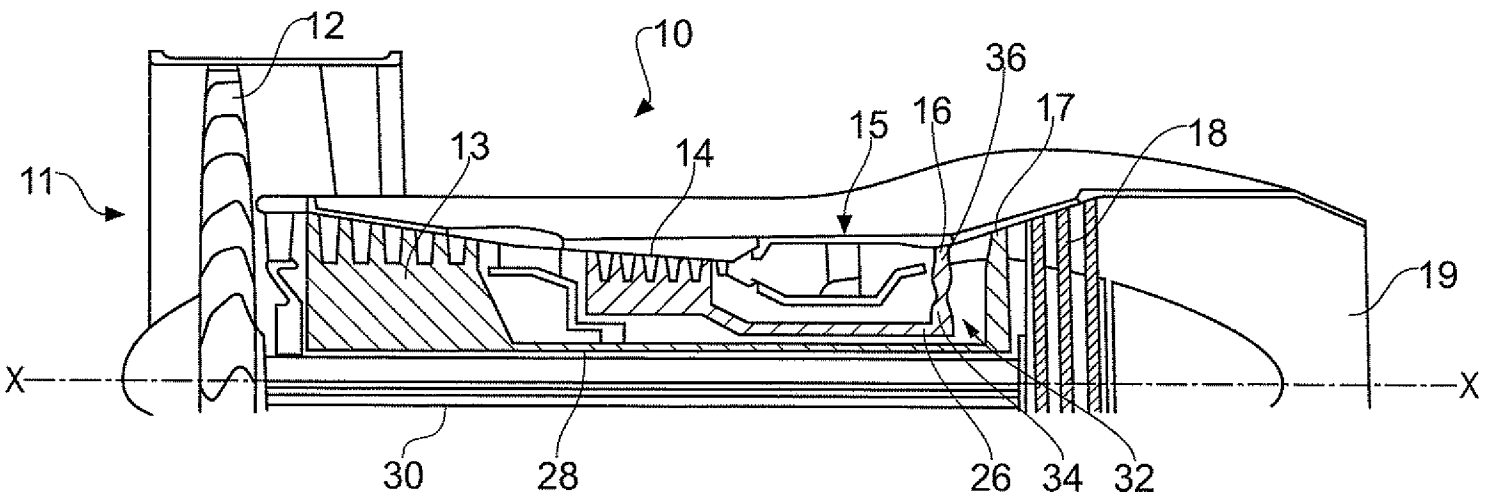
FIG. 1 is a cross-sectional view of an upper half of turbomachine, a turbofan gas turbine engine having a turbine rotor assembly according to the present invention.

A turbofan gas turbine engine 10, as shown in FIG. 1, comprises in flow series an intake 11, a fan 12, an intermediate pressure compressor 13, a high pressure compressor 14, a combustor 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 14 via a second shaft 28 and the low pressure turbine 19 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustor 15. Fuel is injected into the combustor 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

Figure 2:
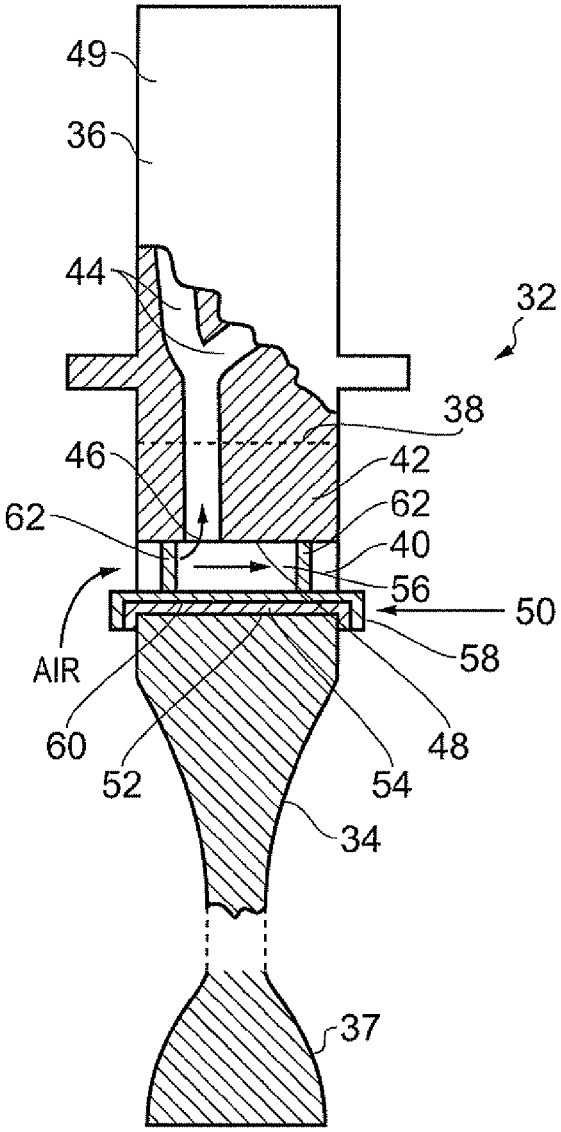
FIG. 2 is an enlarged cross-sectional view through a portion of a turbine rotor assembly according to the present invention.

The high pressure turbine 16, as shown in FIG. 2, comprises a turbine rotor assembly 32 according to the present invention. The turbine rotor assembly 32 comprises a turbine rotor, a turbine disc, 34 and a plurality of circumferentially spaced radially outwardly extending turbine rotor blades 36. The turbine rotor, turbine disc, 34 has a hub 37 and a rim 38 and a plurality of circumferentially spaced slots 40 are provided in the rim 38 of the turbine rotor, turbine disc 34. Each turbine rotor blade 36 has a root 42 and the root 42 of each turbine rotor blade 36 is arranged in a corresponding one of the slots 40 in the rim 38 of the turbine rotor, turbine disc 34. The root 42 of each turbine rotor blade 36 is firtree shaped, or dovetail shaped, in cross-section and each slot 40 is correspondingly shaped to receive the root 42 of the corresponding turbine rotor blade 36.

The turbine rotor blades 36 are hollow and are provided with internal cooling passages 44 to allow a flow of coolant there-through to cool the aerofoil 49 of the turbine rotor blades 36. The coolant is supplied along each slot 40 in the rim 38 of the turbine rotor, turbine disc, 34 to an aperture, or to apertures, 46 in a radially inner surface 48 of the root 42 of the corresponding turbine rotor blade 36. The aperture 46 in the radially inner surface 48 of the root 42 of each turbine rotor blade 36 supplies coolant to the internal cooling passages 44 in the turbine rotor blade 36.

Figure 3:
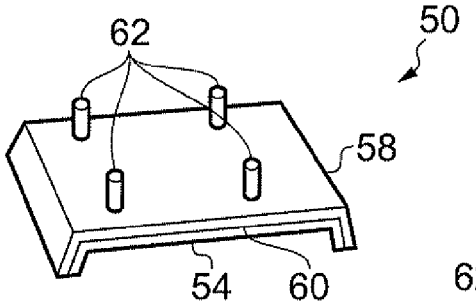
FIG. 3 is a perspective view of a chocking device of a turbine rotor assembly according to the present invention.

Each of the slots 40 in the rim 38 of the turbine rotor, turbine disc, 34 has a chocking device 50 and each chocking device 50 abuts a radially inner surface 52 of the corresponding slot 40 and each chocking device 50 also abuts a radially inner surface 48 of the root 42 of the corresponding turbine rotor blade 36. Each chocking device 50 comprises a thermally insulating material 54 adjacent the radially inner surface 52 of the corresponding slot 40 in the rim of the turbine rotor, turbine disc, 34 and each chocking device 50 forms a space 56 between the thermally insulating material 54 and the radially inner surface 48 of the root 42 of the corresponding turbine rotor blade 36. Each chocking device 50, as shown in FIG. 3, comprises a member 58 and the thermally insulating material 54 is arranged on a radially inner surface 60 of the member 58 and a plurality of projections 62 extending radially outwardly from the member 58. Each chocking device 50, in FIG. 3, comprises a sheet member 58, a thermally insulating material 54 arranged on the radially inner surface 60 of the sheet member 58 and a plurality of projections 62 extending radially outwardly from the sheet member 58.

Figure 4:
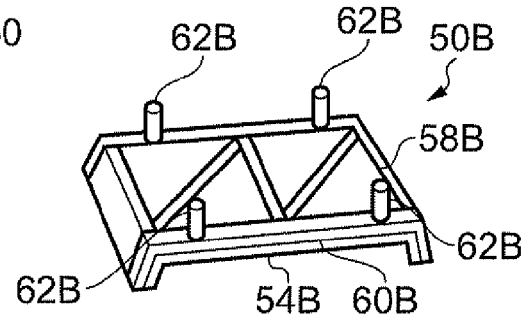
FIG. 4 is a perspective view of an alternative chocking device of a turbine rotor assembly according to the present invention.

Alternatively each chocking device 50B, as shown in FIG. 4, comprises at least one wire member 58B, a thermally insulating material 54B arranged on the radially inner surface 60B of the wire member 58B and a plurality of projections 62B extending radially outwardly from the wire member 58B. The wire member 58B comprises a single bent wire member or comprises a plurality of wires welded together. The wire member 58 may comprise an open framework. The wire member 58B is arranged such that there are no stress concentrations or sharp edges.

The thermally insulating material 54, 54B comprises a material with low density and low thermal conductivity. For example the thermally insulating material 54, 54B has a density of about 0.18 $gc^{-3}$ and a thermal conductivity of about 90 $mW/m^{-K}$ at 600° C. The thermally insulating material 54, 54B may have a thickness of 5 mm or 10 mm or thicknesses between 5 mm and 10 mm.

The thermally insulating material may comprise an aerogel. The thermally insulating material may comprise a silica aerogel. The thermally insulating material may comprise a silica aerogel containing reinforcing fibres. The thermally insulating material may comprise silica aerogel containing non-woven reinforcing fibres. The thermally insulating material may comprise silica aerogel containing reinforcing glass fibres. The thermally insulating material may comprise Pyrogel XT® or Pyrogel XTF® and is obtainable from Aspen Aerogels, Inc, 30 Forbes Road, Building B, Northborough, Mass. 01532, USA. An aerogel is a highly porous solid formed from a gel and in which the liquid is replaced by a gas.

In operation of the turbofan gas turbine engine 10, coolant flows along and/or through each slot 40 in the rim 38 of the turbine rotor, turbine disc, 34 to the aperture, or apertures, 46 in the radially inner surface 48 of the root 42 of the corresponding turbine rotor blade 36. In particular the coolant flows through the space 56 between the thermally insulating material 54 of each chocking device 50 and the radially inner surface 48 of the root 42 of the corresponding turbine rotor blade 36. The provision of the chocking devices 50 in the slots 40 in the rim 38 of the turbine rotor, turbine disc, 34 and in particular the thermally insulating material 54 reduces the heat transfer from the turbine rotor, turbine disc, 34, e.g. the radially inner surfaces 52 of the slots 40, to the coolant flow in the slots 34 in the rim 38 of the turbine rotor, turbine disc, 34 and thus reduces the thermal response of those regions of the turbine rotor, turbine disc, 34 adjacent the slots 40 with variations in thrust of the gas turbine engine 10. In other words the thermally insulating material 54 introduces a thermal lag between the temperature of the coolant flow and the local metal temperature in the regions of the turbine rotor, turbine disc, 34 adjacent the slots 40 during thermaltransients, e.g.

variations in thrust of the gas turbine engine 10. The thermal lag between the temperature of the coolant flow and the local metal temperature in the regions of the turbine rotor, turbine disc, 34 adjacent the slots 40 reduces the difference between the thermal response of the region of the turbine rotor, turbine disc, 34 adjacent the slots 40 and the remainder of the turbine rotor, turbine disc, 34 for example the hub 37 and therefore reduces the thermal stresses in the region of the turbine rotor, turbine disc, 34 adjacent the slots 40 of the turbine rotor, turbine disc, 34. The thermal lag reduces the thermal gradient between the slots 40 in the rim 38 of the turbine rotor, turbine disc, 34 and the hub, or bore, 37 of the turbine rotor, turbine disc, 34, which in turn reduces the thermal stresses in the region of the turbine rotor, turbine disc, adjacent the slots 40. It is predicted that during an acceleration of the gas turbine engine 10 the thermal gradient between the slots 40 and the bore of the turbine rotor, turbine disc, 34 will be reduced by 100° C. and it is predicted that during a deceleration the thermal gradient will be reduced by about 50° C. for temperatures of the turbine disc 34 up to 650° C.

The aerogel is a soft material and prevents fretting between the radially inner surface 52 of the slots 40. The provision of a wire member 58 reduces the weight of the chocking device 50

Figure 5:
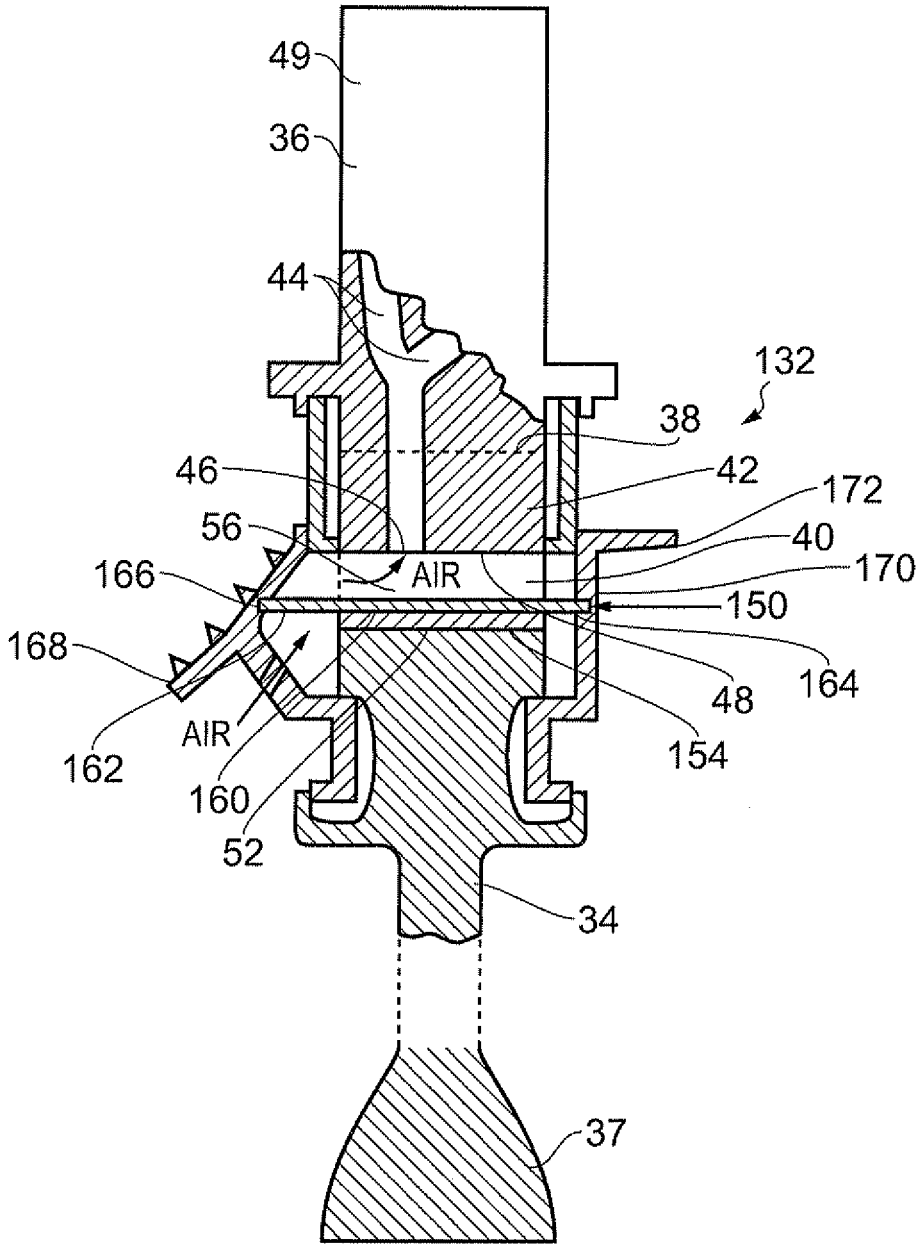
FIG. 5 is an enlarged cross-sectional view through a portion of an alternative turbine rotor assembly according to the present invention.

A further turbine rotor assembly 132 according to the present invention is shown in FIG. 5. The turbine rotor assembly 132 is substantially the same as that shown in FIG. 2, and like parts are denoted by like numerals. The turbine rotor assembly 132 differs in that each of the slots 40 in the rim 38 of the turbine rotor, turbine disc, 34 has a plate member 150 and each plate member 150 abuts a radially inner surface 52 of the corresponding slot 40 and each plate member 150 comprises a thermally insulating material 154 adjacent the radially inner surface 52 of the corresponding slot 40 in the rim of the turbine rotor, turbine disc, 34 and each plate member 150 forms a space 56 between the thermally insulating material 154 and the radially inner surface 48 of the root 42 of the corresponding turbine rotor blade 36. The thermally insulating material 154 is arranged on a radially inner surface 160 of the plate member 158. Each plate member 150 may comprise a sheet member.

An axially upstream end 162 of each plate member 150 locates in a slot 166 in a rim cover plate 168 and an axially downstream end 164 of each plate member 150 locates in a slot 170 in a downstream seal plate 172. Thus the rim cover plate 168 and the downstream seal plate 172 support each plate member 150. An upstream seal plate 174 is provided radially outwardly of the rim cover plate 168. The rim cover plate 168 and the upstream seal plate 174 are located at the upstream end of the turbine rotor 34 and the downstream seal plate 172 is located at the downstream end of the turbine rotor 34. The rim cover plate 168, the upstream seal plate 174 and the downstream seal plate 172 prevent the leakage of fluid across the turbine rotor 34 through the gaps between the shanks of the turbine rotor blades 36 and/or between the gaps between the roots 42 of the turbine rotor blades 36 and the slots 40 in the turbine rotor 34. In this arrangement the coolant is arranged to flow to the slots 40 by flowing through the spaces circumferentially between adjacent plate members 150.

In another embodiment, it may be possible to arrange for each plate member to be integral with, or joined to, the rim cover plate or to arrange for each plate member to be integral with, or joined to, the downstream seal plate. Some of the plate members may be integral with, or joined to, the rim cover plate and some of the plate members may be integral with, or joined to, the downstream seal plate.

The turbine rotor may be turbine disc or a turbine drum.

Although the present invention has been described with reference to providing each slot with a chocking device or a plate member, the present invention is also applicable if at least one of the slots has a chocking device or a plate member.

Figure 6:
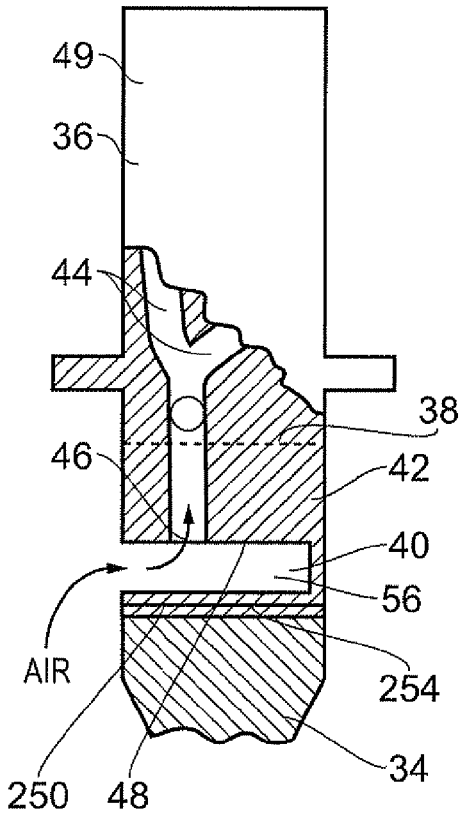
FIG. 6 is an enlarged cross-sectional view through a portion of a further turbine rotor assembly according to the present invention.

FIG. 6 shows a retaining structure 250 on the radially inner end of the/each turbine rotor blade 36 to retain the thermally insulating material 254. The retaining structure 250 may comprise a box structure. The box structure is open at its upstream end to receive the coolant flow and is closed at its downstream end. The retaining structure 250 allows the coolant to flow through the box structure 250 and into the aperture, or apertures, 46 in the radially inner surface 48 of the root 42 of the turbine rotor blade 36. The retaining structure 250 is spaced from the inner surface 52 and the side surfaces of the slot 40. The thermally insulating material 154 is adjacent the radially inner surface 52 of the corresponding slot 40 in the rim of the turbine rotor, turbine disc, 34 and each retaining member 250 forms a space 56 between the thermally insulating material 254 and the radially inner surface 48 of the root 42 of the corresponding turbine rotor blade 36. The thermally insulating material 254 is arranged on a radially inner surface of the retaining structure 250. The retaining structure 250 may be integral with, or secured to, the turbine rotor blade 36. The upstream end of each retaining structure may have a plate member arranged to abut the upstream face of the turbine rotor, turbine disc, 34 adjacent the respective slot 40 to form a dead zone between the radially inner surface 52 of the slot 40 in the turbine rotor, turbine disc, 34 and the radially inner surface of the retaining structure so that static air may be used as the thermally insulating material.

Although the present invention has been described with reference to the use of a thermally insulating material comprising an aerogel, it is equally possible for other suitable thermally insulating materials to be used. For example the thermally insulating material may be air. If air is the thermally insulating material, the turbine rotor blades are provided with internal cooling passages to allow a flow of coolant therethrough to cool the aerofoil of the turbine rotor blades. However, in this embodiment the coolant is supplied between the rim of the turbine rotor, turbine disc, and the platforms of the turbine rotor blades to an aperture, or to apertures, in a surface of the shank of the corresponding turbine rotor blade. In addition some coolant is supplied along each slot in the rim of the turbine rotor, turbine disc, and the coolant is arranged to produce a thermally insulating material, in a dead zone, between the radially inner surface of each slot in the rim of the turbine rotor, turbine disc, and the radially inner surface of the root of each turbine rotor blade. In this case the thermally insulting material may be static air.

The invention claimed is:

1. A turbine rotor assembly comprising:

a turbine rotor; and a plurality of circumferentially spaced radially outwardly extending turbine rotor blades, the turbine rotor having a hub, a rim and a plurality of circumferentially spaced slots provided in the rim of the turbine rotor, each turbine rotor blade having a root, the root of each turbine rotor blade being arranged in a corresponding one of the slots in the rim of the turbine rotor, each turbine rotor blade being hollow, each turbine rotor blade being provided with at least one internal cooling passage for a coolant, each turbine rotor blade having at least one aperture arranged to supply coolant to the at least one internal cooling passage in the turbine blade, the at least one aperture being in a radially inner surface of the root, at least one of the slots having a thermally insulating material adjacent a radially inner surface of the slot wherein the thermally insulating material reduces the temperature gradient between a region of the turbine rotor adjacent the at least one slot and the hub of the rotor, a space being formed between the thermally insulating material and the radially inner surface of the root of the turbine rotor blade in the at least one of the slots to allow the coolant to be supplied to the at least one aperture.

2. A turbine rotor assembly as claimed in claim 1 wherein at least one of the slots has a chocking device, the at least one chocking device abutting the radially inner surface of the slot, the chocking device abutting the radially inner surface of the root of the corresponding turbine rotor blade, the chocking device comprising a thermally insulating material adjacent the radially inner surface of the slot, and the chocking device forming the space.

3. A turbine rotor assembly as claimed in claim 2 wherein each of the slots has a chocking device, each chocking device abutting the radially inner surface of the slot, each chocking device abutting the radially inner surface of the root of the corresponding turbine rotor blade, each chocking device comprising a thermally insulating material adjacent the radially inner surface of the slot and each chocking device forming the space.

4. A turbine rotor assembly as claimed in claim 2 wherein each chocking device comprises a member, a thermally insulating material being arranged on a radially inner surface of the member and a plurality of projections extending radially outwardly from the member, the radially outward extending projections forming the space between the member and the radially inner surface of the root of the corresponding turbine rotor blade.

5. A turbine rotor assembly as claimed in claim 4 wherein each chocking device comprises a sheet member, a thermally insulating material being arranged on a radially inner surface of the sheet member and a plurality of projections extending radially outwardly from the sheet member.

6. A turbine rotor assembly as claimed in claim 4 wherein each chocking device comprises at least one wire member, a thermally insulating material being arranged on a radially inner surface of the wire member and a plurality of projections extending radially outwardly from the wire member.

7. A turbine rotor assembly as claimed in claim 6 wherein the wire member comprises at least one bent wire member or a plurality of wires welded together.

8. A turbine rotor assembly as claimed in claim 1 wherein at least one of the slots has a plate member, the at least one plate member abutting the radially inner surface of the slot, the plate member having a thermally insulating material adjacent the radially inner surface of the slot, and the plate member being spaced from the radially inner surface of the root of the corresponding turbine rotor blade to form the space between the thermally insulating material and the radially inner surface of the root of the corresponding turbine rotor blade.

9. A turbine rotor assembly as claimed in claim 8 wherein each of the slots has a plate member, each plate member abutting the radially inner surface of the slot, each plate member comprising a thermally insulating material adjacent the radially inner surface of the slot and each plate member forming the space.

10. A turbine rotor assembly as claimed in claim 8 wherein the turbine rotor assembly comprises a rim cover plate at a first axial end of the turbine rotor and a seal plate at a second axial end of the turbine rotor, each plate member being supported by the rim cover plate and/or the seal plate.

11. A turbine rotor assembly as claimed in claim 1 wherein a retaining structure on the radially inner end of at least one of the turbine rotor blades retains the thermally insulating material, the retaining structuring comprising a box structure, the box structure being open at an upstream end of the box structure and closed at a downstream end of the box structure, the retaining structure forming the space between the thermally insulating material and the radially inner surface of the root of the corresponding turbine rotor blade.

12. A turbine rotor assembly comprising:

a turbine rotor; and a plurality of circumferentially spaced radially outwardly extending turbine rotor blades, the turbine rotor having a hub, a rim and a plurality of circumferentially spaced slots provided in the rim of the turbine rotor, each turbine rotor blade having a root, the root of each turbine rotor blade being arranged in a corresponding one of the slots in the rim of the turbine rotor, each turbine rotor blade being hollow, each turbine rotor blade being provided with at least one internal cooling passage for a coolant, each turbine rotor blade having at least one aperture arranged to supply coolant to the at least one internal cooling passage in the turbine blade, at least one of the slots having a thermally insulating material adjacent a radially inner surface of the slot wherein the thermally insulating material reduces the temperature gradient between a region of the turbine rotor adjacent the at least one slot and the hub of the rotor, the thermally insulating material comprising an aerogel.

13. A turbine rotor assembly as claimed in claim 12 wherein the thermally insulating material comprises a silica aerogel.

14. A turbine rotor assembly as claimed in claim 13 wherein the thermally insulating material comprises silica aerogel containing reinforcing fibres.

15. A turbine rotor assembly as claimed in claim 14 wherein the thermally insulating material comprises silica aerogel containing non-woven reinforcing fibres.

16. A turbine rotor assembly as claimed in claim 14 wherein the thermally insulating material comprises silica aerogel containing reinforcing glass fibres.

17. A turbine rotor assembly comprising:

a turbine rotor; and a plurality of circumferentially spaced radially outwardly extending turbine rotor blades, the turbine rotor having a hub, a rim and a plurality of circumferentially spaced slots provided in the rim of the turbine rotor, each turbine rotor blade having a root, the root of each turbine rotor blade being arranged in a corresponding one of the slots in the rim of the turbine rotor, each turbine rotor blade being hollow, each turbine rotor blade being provided with at least one internal cooling passage for a coolant, each turbine rotor blade having at least one aperture arranged to supply coolant to the at least one internal cooling passage in the turbine blade, the at least one aperture being in a surface of a shank of each turbine rotor blade, the surface of the shank being between the rim of the turbine rotor and a platform of the corresponding turbine rotor blade, at least one of the slots having a thermally insulating material adjacent a radially inner surface of the slot wherein the thermally insulating material reduces the temperature gradient between a region of the turbine rotor adjacent the at least one slot and the hub of the rotor.

18. A turbine rotor assembly as claimed in claim 17 wherein the thermally insulating material comprises air.

19. A turbine rotor assembly as claimed in claim 11 wherein the thermally insulating material comprises air.

20. A turbine rotor assembly as claimed in claim 1 wherein the turbine rotor is a turbine disc.

21. A turbine rotor assembly as claimed in claim 1 wherein the turbine rotor assembly is a gas turbine engine turbine rotor assembly.

22. A turbine rotor assembly as claimed in claim 1 wherein the thermally insulating material comprises an aerogel.

23. turbine rotor assembly as claimed in claim 1 wherein the at least one slot is open at an upstream end of the at least one slot.

* * * * *